US006777602B2

(12) United States Patent
Hautamaki et al.

(10) Patent No.: US 6,777,602 B2
(45) Date of Patent: Aug. 17, 2004

(54) PLECTRUM FOR USE WITH A STRINGED MUSICAL INSTRUMENT

(76) Inventors: Glenn J. Hautamaki, 1854 Main Street East, Hamilton, ON (CA), L8E 3C4; Raymond R. Lyell, 1010 Upper Wentworth Street East, Hamilton, Ontario (CA), L9A 4V9

( * ) Notice: Subject to any disclaimer, the term of this patent is extended or adjusted under 35 U.S.C. 154(b) by 0 days.

(21) Appl. No.: 10/294,567

(22) Filed: Nov. 15, 2002

(65) Prior Publication Data

US 2003/0106410 A1 Jun. 12, 2003

Related U.S. Application Data

(60) Provisional application No. 60/336,685, filed on Dec. 7, 2001.

(51) Int. Cl.[7] ..... G10D 3/16

(52) U.S. Cl. ..... 84/322; 84/320

(58) Field of Search ..... 84/322, 320, 321

(56) References Cited

U.S. PATENT DOCUMENTS 2,449,890 A * 9/1948 Garlick ..... 84/322
6,133,516 A * 10/2000 Hendrickson ..... 84/322

* cited by examiner

*Primary Examiner*—Kimberly Lockett

(57) ABSTRACT

The present invention is an improved plectrum for use with a stringed musical instrument, having a substantially planar central gripping portion and three or more substantially planar picking wing portions peripherally extending one each in a respective different longitudinal direction from the central gripping portion, such that only one of the wing portions may be used at any one time, such that the wing portion, and wherein each of the wing portions is of a different relative thickness, so as to produce a different relative tone when each is respectively used.

11 Claims, 2 Drawing Sheets

PLECTRUM FOR USE WITH A STRINGED MUSICAL INSTRUMENT

This application claims the benefit of Provisional application Ser. No. 60/336,685, filed Dec. 7, 2001.

FIELD OF THE INVENTION

The present invention relates generally to a guitar pick or a plectrum for use with a stringed musical instrument, and more particularly, to an improved plectrum for use with a stringed musical instrument.

BACKGROUND OF THE INVENTION

In playing a guitar, bass guitar, or other stringed musical instrument, a musician will typically use a pick or plectrum to pluck one or more strings of the instrument, thus effecting vibration in the strings of the instrument, thus effecting vibrations in the strings and thereby generating sounds and tones. Quite apart from any particular musical notes that may be sounded, the tones produced will vary inter alia according to a thickness of the plectrum employed and an inherent flexibility of a material from which the plectrum is constructed. As such, in selecting the particular material and thickness of the plectrum to be used, the musician must consider whether he wishes to produce soft and mellow tones, such as those that are known to be produced by relatively thick and rigid plectra and that are generally preferred inter alia when playing chords, when playing in a rhythm position, and when playing the bass guitar, or alternately whether he wants to generate share and crisp tones, such as those that are known to be produced by relatively thin and flexible plectra and that are typically desirable inter alia when picking melodies and when playing in a lead guitar position.

As well, in contemporary times, the musician is frequently called upon to produce a number of different tones in a single performance. In fact, it is not uncommon for today's performing musician to need to produce three or more different tones within a span of the performance. That is, depending on the complexity and arrangement of a particular song or set list, the modem musician may, for example, be required to switch from the lead to the rhythm guitar position, or may even need to change instruments altogether, perhaps playing the bass guitar as well. Further, with an anxious and discerning audience listening, changes between the different tones sometimes need to occur within very short periods of time, such as, for example, from one song to the next, or even within the course of a single song.

In the past, when musicians needed to produce these different tones in their respective performance, they would commonly equip themselves with a number of different plectra, each being of a different single thickness and material of construction, as appropriate. However, since the old adage "the show must go on" remains as true today as ever, even the musician that only expects to play a single type of tone will ordinarily carry more than one plectrum, so as to have a backup pick readily available if needed. Carrying a number of plectra is an already cumbersome task for a stage-weary guitarist, and when the musician is further required to keep track of where he has placed a number of different types of plectra, either on his person or on a dimly lit stage, the significant possibility exists that a particular desired plectrum might be misplaced or misidentified at the very moment that it is required.

As such, a number of different approaches have been taken to provide multi-tonal picks of consolidated construction, such as, for example, plectra that are constructed from two different materials in bonded relation. An example of such a device may be seen in U.S. Pat. No. 5,271,309 (Balog) for a Soft Attack Guitar Pick. The Balog patent discloses a pick formed by inserting a hard plastic pick into a hard felt one, and thereafter bonding the two picks together with a silicone adhesive. However, the Balog pick suffers from a significant problem insofar as it is capable of producing only two different types of tones. Further, plectra such as that disclosed by Balog are also subject to the distinct possibility that the two bonded picks may become detached from each other, possibly even at a quite inopportune time, with the result being that the performance may be interrupted and the listening audience may become displeased or irritated.

Plectra having more than one playing point of different relative thicknesses have also been developed to address this problem. One such device may be seen in U.S. Pat. No. 2,449,890 (Garlick) for a Pick For Stringed Instruments. The Garlick Patent discloses a pick of singular and generally planar construction that has two opposing faces arranged in converging relation from an intermediate point to one and thereof so as to provide two opposite string engaging ends of different relative thicknesses. Once again, as with the Balog patent discussed above, the device disclosed by Garlick is capable of producing only two different tones. Furthermore, it is not possible to adapt the Garlick design, having two converging faces, to provide a pick capable of playing any more than two different tones. Thus, the pick disclosed by Garlick would have little or no utility to a musician that is called upon to play, for example, in both the lead and rhythm guitar positions and on more than one instrument within the span of the performance.

Another device that has been developed with two or more playing points of different relative thicknesses may be seen in U.S. Pat. No. 2,481,759 (Lawrence) for a Plectrum With Two Playing Points. The Lawrence patent discloses a plectrum with two playing numbs of different thicknesses that are arranged closely together so that both may be brought into play at the same time. The disclosure of the Lawrence patent also claims that either one of the playing numbs may be used separately from the other. However, a significant problem with the Lawrence plectrum remains that, because the playing nubs are arranged sufficiently close to each other that they may be brought to bear against the strings of the musical instrument at the same time, it takes a great deal of control and skill on the part of the performing musician to accurately draw the plectrum across the strings in such a manner that only one of the nubs makes contact therewith. Accordingly, the Lawrence device requires that the performing musician be of a certain advanced level of ability in order to exert the appropriate control over the plectrum. The limitations inherent in this requirement are further exacerbated when one considers that even a skilled musician may become tired and stage-weary at the end of a long performance, with a consequent loss of control over the plectrum, such that both of the playing nubs of the Lawrence plectrum may inadvertently contact the stringed instrument and thus produce multiple tones at an inappropriate time. As such, a significant problem with the Lawrence device is the difficulty experienced by musicians in attempting to use same to produce single-toned notes.

Yet another device that has been developed to produce two different relative tones may be seen in U.S. Pat. No. 3,439,570 (Lee) for a Stringed Musical Instrument Having a Slidably Mounted Neck. The Lee patent discloses inter alia a novel pick construction that has opposing flexible narrow pick fingers of different size and flexibility. However, even aside from its significant structural disadvantages when compared with standard plectra, the Lee pick is specifically designed only for use with stringed musical instruments having a corresponding pick guide, and as such, it has little or no utility when employed apart therefrom.

A still further device that has been developed to provide a single pick capable of producing a number of different relative tones may be seen in U.S. Pat. No. 4,228,719 (Keene) for a Plectrum For Stringed Musical Instruments. The Keene plectrum discloses a substantially planar pick constructed of a single material and having three plucking corners, with two or more of said plucking corners having respectively different sized holes formed adjacent thereto, so as to provide each with a different respective flexibility and resiliency. While the Keene plectrum is capable of producing three different tones, its structural integrity is reduced by the holes formed there through, and as such, the pick is subject to the significant possibility that it may snap or otherwise break during the performance.

Prior to the present invention, there has not been any satisfactory and unitary solution to the combined problems presented by the need to provide and easy to use and durable flexible plectrum for use with stringed musical instruments that is capable of producing a wide variety of tones, such as a musician may be called upon to provide in the course of a single performance.

The primary object of the invention is to provide an improved plectrum for use with a stringed musical instrument that has a number of substantially planar picking wing portions of different relative thicknesses, each respectively producing a different relative tone when used.

Another object of the invention is to provide an improved plectrum for use with a stringed musical instrument that, quite apart from the particular musical note being played, is capable of selectively producing a wide range of individual tones.

A further object of one aspect of the invention is to provide an improved plectrum for use with a stringed musical instrument, wherein only one of said wing portions may be used at any one time.

Yet another object of the invention is to provide an improved plectrum for use with a stringed musical instrument, wherein a musician may quickly and easily switch between each of said wing portions.

A yet further object of the invention is to provide an improved plectrum for use with a stringed musical instrument that is easy to use.

Still another object of the invention is to provide an improved plectrum for use with a stringed musical instrument that has a natural feel and is easily grippable.

Yet still another object of the invention is to provide an improved plectrum for use with a stringed musical instrument that has an aesthetically pleasing shape.

A still further object of the invention is to provide an improved plectrum for use with a stringed musical instrument that has a wide range of applications, such as, for example, in association with bass, lead and rhythm guitars.

A still yet further object of the invention is to provide an improved plectrum for use with a stringed musical instrument that has a durable construction.

An additional object of the invention is to provide an improved plectrum for use with a stringed musical instrument that is easy and inexpensive to manufacture.

SUMMARY OF THE INVENTION

There is thus provided, according to one aspect of the invention, an improved plectrum for use with a stringed musical instrument. The improved plectrum has a substantially planar central gripping portion and three or more substantially planar picking wing portions peripherally extending one each in a respective different longitudinal direction from the central gripping portion. Only one of the wing portions may be used at any one time. The wing portions comprise at least a first, a second, and a third wing portion. Each of the wing portions is of a different relative thickness, so as to produce a different relative tone when each is respectively used.

According to another aspect of the invention, the central gripping portion has one or more raised grippable portions.

Accordingly to a further aspect of the invention, each respective different longitudinal direction is equally spaced, relative to each adjacent respective different longitudinal direction, about the central gripping portion.

According to yet another aspect of the invention, the wing portions further comprise at lest a fourth wing portion.

Accordingly to still another aspect of the invention, the second wing portion is thicker than the first wing portion, the third wing portion is thicker than the second wing portion, and the fourth wing portion is thicker than the third wing portion. The first wing portion extends from the central gripping portion in a corresponding first longitudinal direction that is in substantially diametrically opposed relation relative to the respective different longitudinal direction of the second wing portion. As well, the third wing portion extends from the central gripping portion in a corresponding third longitudinal direction that is in substantially diametrically opposed relation relative to the respective different longitudinal direction of the fourth wing portion.

Accordingly to still yet another aspect of the invention, the wing portions and the central gripping portion are in partially coplanar relation with each other.

According to a still further aspect of the invention, the partially coplanar relation is such that the wing portion and the central gripping portion together define a common substantially planar first face.

Accordingly to a yet further aspect of the invention, the one or more raised grippable portions extend from a second face of the substantially planar central gripping portion.

Accordingly to a yet still further aspect of the invention, the one or more raised grippable portions comprise one raised grippable portion.

According to another aspect of the invention, the improved plectrum for use with a stringed musical instrument is formed in a single piece and is of moulded construction.

The present invention a plectrum for use with stringed instruments, said plectrum comprises:

a) a central planar gripping portion for gripping and holding said plectrum;

b) at least two wing portions connected to and emanating from said gripping portion, such that each wing portion extending along a longitudinal direction;

c) the wing portions each having a tip portion adapted for strumming or plucking stringed instruments.

Preferably wherein said plectrum including wing portions with at least two different thicknesses.

Preferably wherein said plectrum including at least two diametrically opposed wing portions extending along a first longitudinal direction and a second longitudinal direction respectively.

Preferably wherein said plectrum including wing portions with at least two different thicknesses.

Preferably wherein said plectrum including planar wing portions which are coplanar on one side defining a coplanar first face.

Preferably further including a central raised grippable portion centrally located on said central gripping portion.

Preferably wherein said grippable portion including a raised dimple for contacting with a finger.

Preferably wherein said wing portions equally spaced about the periphery of said central gripping portion.

Preferably 1 further including at least four wing portions each extending along a longitudinal direction.

Preferably wherein each longitudinal direction spaced ninety degrees apart from each other such that said wing portions are equally spaced about the periphery of the central gripping portion.

Preferably wherein each wing portion having a different thickness thereby each wing portion providing a unique plucking characteristic.

Preferably wherein said wing portions together with said central gripping portion defining a coplanar first face and a non coplanar second face.

Preferably wherein said wing portions tapered and culminating into a rounded tip portion such that each wing portion adapted for strumming or plucking stringed instruments.

In another embodiment the present invention a plectrum for use with stringed instruments, said plectrum comprises:

a) a central planar gripping portion for gripping and holding said plectrum, said gripping portion including a centrally located raised portion for improved gripping;

b) four wing portions connected to and emanating from said gripping portion, such that each wing portion extending along a different longitudinal direction;

c) each wing portion having a different thickness and spaced equally around the periphery of said planar central gripping portion and together defining a coplanar first face;

d) the wing portions tapered and culminating into a rounded tip portion such that each wing portion adapted for strumming or plucking stringed instruments.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 1:
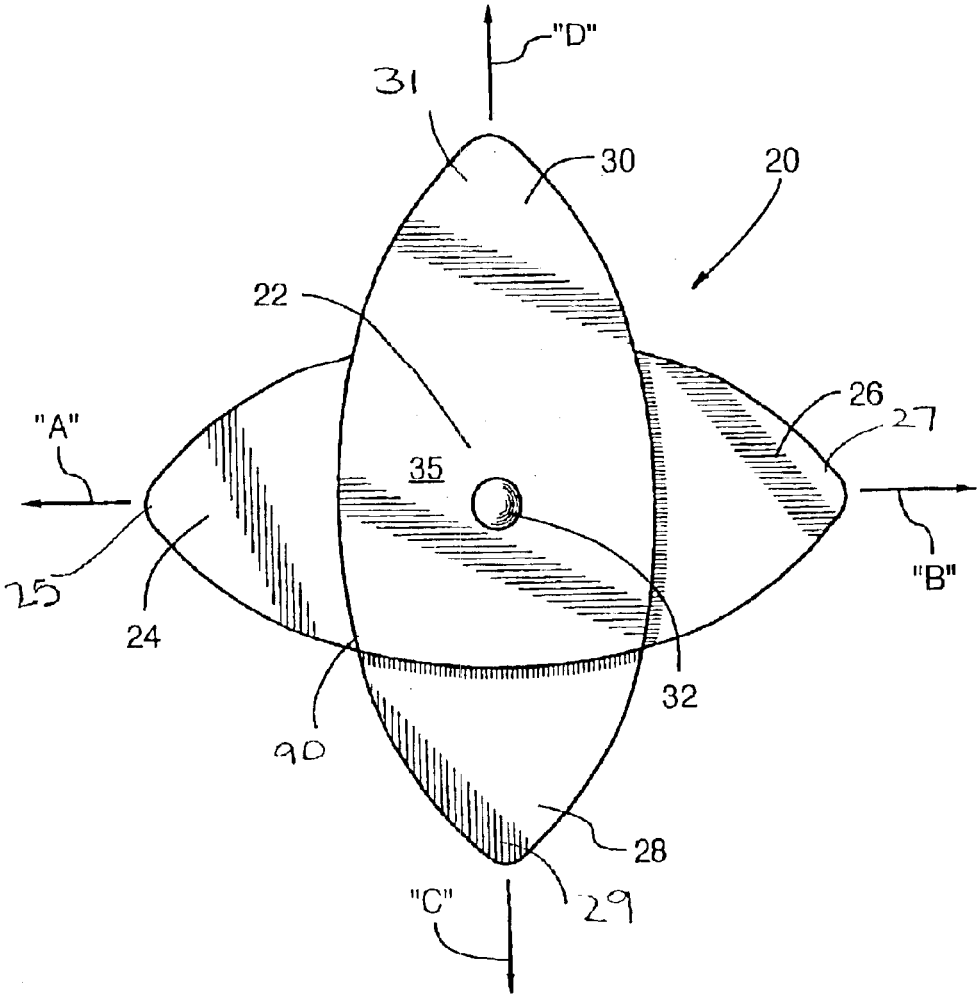
FIG. 1 is a top plan view of an improved plectrum for use with a stringed musical instrument according to the invention.

Referring now to FIGS. 1 through 5 of the drawings, there is shown a preferred embodiment of the improved plectrum 20 for use with a stringed musical instrument (not shown). The improved plectrum 20 has a substantially planar central gripping portion 22 with a periphery 90 and four substantially planar picking wing portions 24, 26, 28 and 30 peripherally extending one each in a respective different longitudinal direction (as indicated respectively by arrows "A", "B", "C" and "D") from the central gripping portion 22. Each wing portion includes a tip portion 25, 27, 29, 31 respectively. In the preferred embodiment and as best illustrated in FIG. 1, each respective different longitudinal direction "A", "B", "C" and "D" is equally spaced, relative to each adjacent respective different longitudinal direction about the central gripping portion 22.

Figure 2:
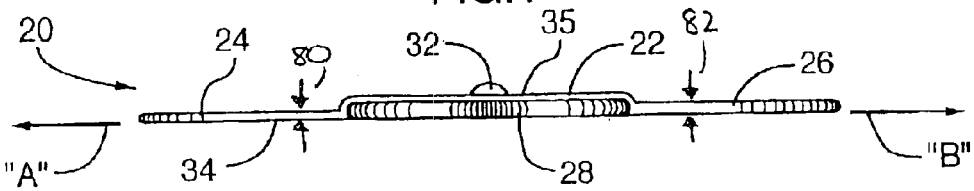
FIG. 2 is a side elevational view of the improved plectrum of FIG. 1.
Figure 3:
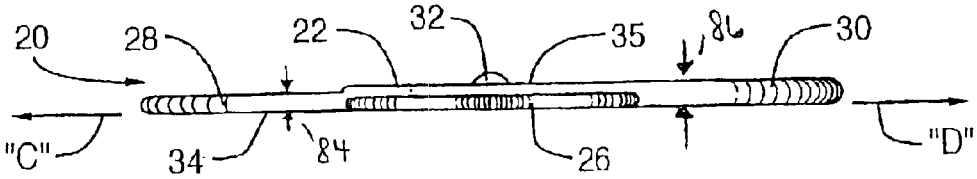
FIG. 3 is an alternate side elevational view of the improved plectrum of FIG. 1.

The four wing portions 24, 26, 28 and 30 comprise a first wing portion 24, a first tip potion 25, a second wing portion 26, second tip portion 27, a third wing portion 28, a third tip portion 29, and a fourth wing portion 30, and a fourth tip portion 31. As best illustrated in FIGS. 2 and 3, each of the wing portions 24, 26, 28 and 30 is of a different relative thickness, so that each will produce a different relative tone when used. In particular, the second wing portion 26 is thicker than the first wing portion 24, the third wing portion 28 is thicker than the second wing portion 26, and the fourth wing portion 30 is thicker than the third wing portion 28.

Thus, the improved plectrum 20 according to the invention has four substantially planar picking wing portions 24, 25, 28, 30 of different relative thicknesses, ranging from a thinnest said wing portion 24 to a thickest said wing portion 30, each of which may be selectively and individually employed to respectively produce each said different relative tone when drawn across the strings of the musical instrument. First wing portion 24 having first thickness 80, second wing portion 26 having second thickness 82, third wing portion 28 having third thickness 84, fourth wing portion 30 having fourth thickness 86. In fact, the design of the plectrum 20 is such that only one of the four wing portions 24, 26, 28, 30 may be used at any one time. As such, the plectrum 20, quite apart from the particular musical note being played, is capable of selectively producing a wide range of individual tones. Accordingly, the design of the present invention is such that the plectrum 20 has a wide range of applications, such as, for example and depending on the thicknesses actually selected, in association with bass, lead and rhythm guitars.

It will be observed that, in the preferred embodiment illustrated in FIGS. 1 through 5, the first wing portion 24 extends from the central gripping portion 22 in a corresponding first longitudinal direction (as indicated by arrow "A" in FIGS. 1, 2, 4 and 5) that is in substantially diametrically opposed relation relative to the respective different longitudinal direction "B" of the second wing portion 26. As well, the third wing portion 28 extends from the central gripping portion 22 in a corresponding third longitudinal direction (as indicated by arrow "C" in FIGS. 1, 3, 4 and 5) that is in substantially diametrically opposed relation relative to the respective different longitudinal direction "D" of the fourth wing portion 30. The substantially planar shaping and equidistant arrangement of the wing portion 24, 26, 28, 30 relative to each other is such that the plectrum 20 has an aesthetically pleasing form that enables a musician using the plectrum 20 to quickly and easily identify each said different relative thickness. As such, the musician may quickly and easily switch between each said different relative thickness corresponding to the first, second, third, and fourth wing portions, 24, 26, 28 and 30 respectively, by simply rotating the plectrum 20 in his hand. Further, because each of the third and fourth wing portions 28, 30 is respectively arranged adjacent to both the first and second wing portions 24, 26 according to the preferred embodiment, the musician may alternately switch between relatively thicker and thinner picking wing portions with each successive quarter turn of the plectrum 20. The shape, sizing, and design of the plectrum 20 are such that, when a certain level of familiarity and comfort therewith are achieved, the musician can selectively rotate it using only one hand. As such, the plectrum 20 according to the present invention is quite easy to use.

Figure 4:
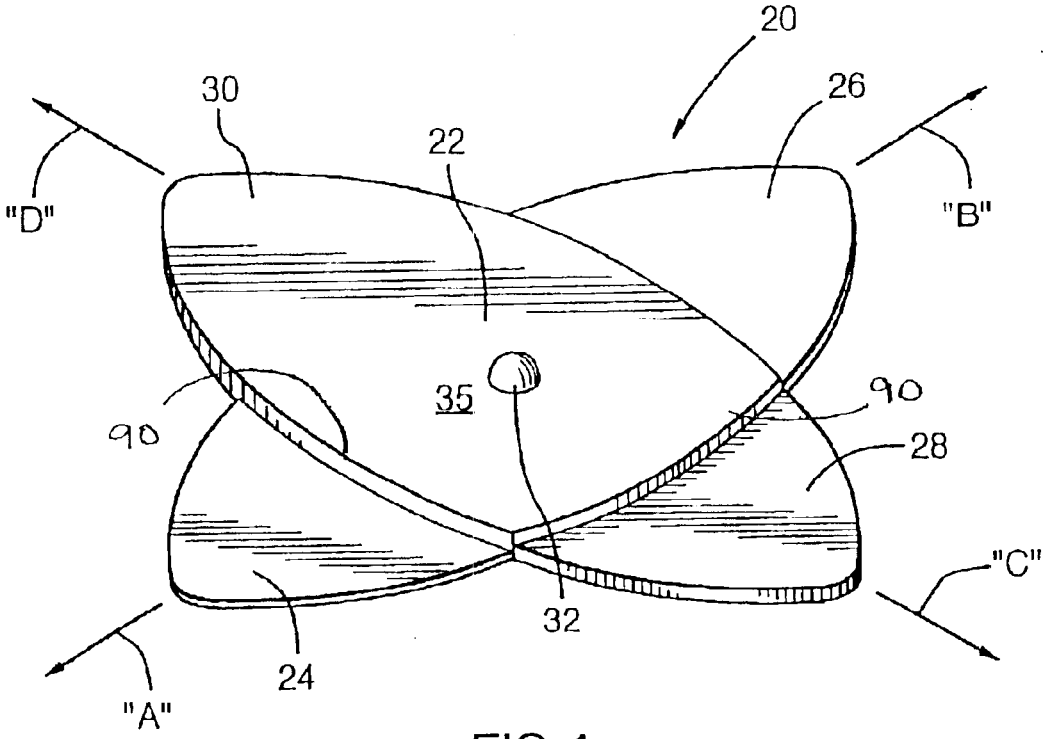
FIG. 4 is a top perspective view of the improved plectrum of FIG. 1.
Figure 5:
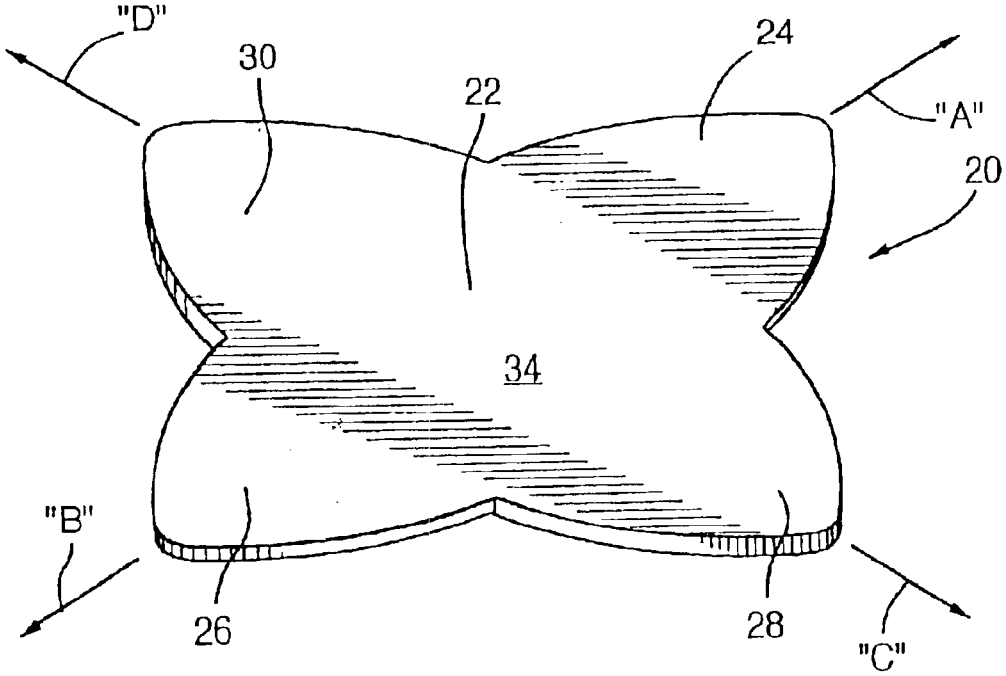
FIG. 5 is a bottom perspective view of the improved plectrum of FIG. 1.

As best illustrated in FIG. 5, the wing portions 24, 26, 28, 30 and the central gripping portion 22 are in partially coplanar relation with each other, such that, together, they define a common substantially planar first face 34. As best illustrated in FIGS. 1 and 4, one raised grippable portion 32 extends from a second face 35 of the substantially planar central gripping portion 22, so as to provide the plectrum 20 with a natural feel and to make it easily grippable.

Preferably, the improved plectrum 20 is constructed from any of a number of plastics materials, provided the materials selected are sufficiently non-rigid, flexible and resilient for the application. As well, the plectrum 20 is preferably formed in a single piece and is melded construction. As such, the plectrum 20 is durable and easy and inexpensive to manufacture.

Other modifications and alterations may be used in the design and manufacture of the present invention without departing from its spirit and scope, which is limited only by the accompanying claims. For example, the improved plectrum 20 is specified as being formed in a single piece and of melded construction, but it might instead be formed from a number of discrete layers bonded together. That is, the improved plectrum 20 might further comprise a substantially planar first layer adhesively bonded to a substantially planar second layer, with the second layer adhesively bonded to a substantially planar third layer, and with the third layer adhesively bonded to a substantially planar fourth layer. According to this contemplated modification, the first layer would be shaped so as to define the first wing portion 24, and a first layer portion of each of the central gripping portion 22 and of the second, third, and fourth wing portions, 26, 28 and 30 respectively. In turn, the second the layer would be shaped so as to define a second layer portion of each of the central gripping portion 22 and of the second, third, and fourth wing portions 26, 28 and 30 respectively. The third layer would be shaped so as to define a third layer portion of each of the central gripping portion 22 and of the third and fourth wing portions, 28 and 30 respectively. Lastly, in accordance with this contemplated modification, the fourth layer would be shaped so as to define the fourth layer portion of the central gripping portion 22 with the raised grippable portion 32 extending therefrom, and a fourth layer portion of the fourth wing portion 30. In this manner, each of the wing portions 24, 26, 28, 30 would respectively be provided with each said different relative thickness.

As an example of a further modification, in the preferred embodiment, the first wing portion 24 extends in the first longitudinal direction "A" that is specified as being substantially diametrically opposed to the longitudinal direction "B" of the second wing portion 26, and the third wing portion 28 extends in the third longitudinal direction "C" that is specified as being substantially diametrically opposed to the longitudinal direction "D" of the fourth wing portion 30, but his need not be the case. That is alternately, the first wing portion 24 extending in the longitudinal direction "A" might be diametrically opposed to the longitudinal direction, "C" or "D", of the third or fourth wing portion, 28 ro 30 respectively, and the second wing portion 26 extending in the longitudinal direction "B" might be diametrically opposed to the corresponding remaining longitudinal direction, "C" or "D", of the third or fourth wing portion, 28 or 30 respectively, as appropriate.

Still further modifications and alterations may be used in the design and manufacture of the present invention without departing from its spirit and scope, such as, for example, the plectrum 20 may be provided with more or less than four wing portions. As well, the different relative thicknesses of the wing portions 24, 26, 28, 30 of the plectrum 20 may be selected from a wide range of possible thicknesses, as appropriate to the particular application. In addition, a lesser number of said different relative thicknesses may be provided than the number of wing portions. That is, for example, while the plectrum 20 may be provided with four different wing portions 24, 26, 28, 30, the wing portions 24, 26, 28, 30 may be of only two different relative thicknesses.

An example of yet another modification that might be made to the present invention would be to provide the plectrum 20 with more than one raised grippable portion 32. As well, either instead of or in addition to the presence of the raised grippable portion 32 extending from the second face 34, one or more alternate raised grippable portions might extend from the common substantially planar first face 34 adjacent the central gripping portion 22. Further, in place of the raised grippable portion 32, the plectrum 20 might be provided with one or more recessed and/or corrugated alternate grippable portions and/or a combination of any such grippable portions. Conversely, the plectrum 20 might be provided without the grippable portion 32 altogether. Likewise, the plectrum 20 might be provided without the common substantially planar first face 34.

In addition, while the present invention is specified as preferably being constructed from a plastic material, this need not be the case. That is, the plectrum 20 might also be constructed from any of a number of metal, natural or synthetic fibrous, or other materials, provided the materials selected are sufficiently non-rigid, flexible and resilient for the application.

Obviously, the present invention allows for a wide variety of different possible combinations of the various modifications and alterations specifically contemplated herein, and as such, it should perhaps be noted once again that the present invention is limited only by the accompanying claims.

It should be apparent to persons skilled in the arts that various modifications and adaptation of this structure described above are possible without departure from the spirit of the invention the scope of which defined in the appended claim.

We claim:

1. A Plectrum for use with stringed instruments, said plectrum comprising:

a) a central planar gripping portion having a periphery, said gripping portion for gripping and holding said plectrum;

b) at least two independent planar wing portions spaced at least 90 degrees apart along differing longitudinal directions connected to and emanating from said periphery of said gripping portion, each planar wing portion, when viewed from the top, having a concave outer contour terminating in a rounded tip portion, such that each said wing defining a conically shaped planar wing portion, wherein each wing portion can be independently used for plucking strings;

c) wherein the tip portion adapted for strumming or plucking stringed instruments; and d) wherein said plectrum including wing portions with at least two different thicknesses.

2. The plectrum claimed in claim 1, wherein said thickness of said central gripping portion and said thickness of said wings portions changes at said periphery of said planar gripping portion such that said wing flexed independently of said gripping portion.

3. The plectrum claimed in claim 1, wherein said plectrum including at leant two diametrically opposed wing portion extending along a first longitudinal direction and a second longitudinal direction respectively.

4. The plectrum claimed in claim 1 wherein said plectrum including planar wing portions which are coplanar on one side defining a coplanar first face.

5. The plectrum claimed in claim 1 further including a central raised grippable portion centrally located on said central gripping portion.

6. The plectrum claimed in claim 5 wherein said grippable portion including a raised dimple for contacting with a finger.

7. The plectrum claimed in claim 1 wherein said wing portions equally spaced about the periphery of said central gripping portion.

8. The plectrum claimed in claim 1 further including at least four wing portions each extending along a longitudinal direction.

9. The plectrum claimed in claim 8 wherein each longitudinal direction spaced ninety degree apart from each other such that said wing portions are equally spaced about the periphery of the central gripping portion.

10. The plectrum claimed in claim 9 wherein each wing portion having a different thickness thereby each wing portion providing a unique plucking characteristic.

11. The plectrum claimed in claim 10 wherein said wing portions together with said central gripping portion defining a coplanar first face and a non coplanar second face.

* * * * *